US007790995B2

(12) United States Patent
Burkett

(10) Patent No.: US 7,790,995 B2
(45) Date of Patent: Sep. 7, 2010

(54) BREAK AWAY BASE FOR ELECTRICAL DEVICE

(76) Inventor: Karl A. Burkett, 4501 Rim Rock Path, Austin, TX (US) 78745

( * ) Notice: Subject to any disclaimer, the term of this patent is extended or adjusted under 35 U.S.C. 154(b) by 460 days.

(21) Appl. No.: 11/849,743

(22) Filed: Sep. 4, 2007

(65) Prior Publication Data

US 2009/0057119 A1 Mar. 5, 2009

(51) Int. Cl.
*H01H 3/16* (2006.01)

(52) U.S. Cl. ..... 200/61.41; 200/52 R; 200/573; 200/300

(58) Field of Classification Search ..... 200/52 R, 200/61.08, 61.41, 61.42, 51 LM, 573, 574, 200/300, 61.62; 307/119, 16; 174/45 R, 174/38; 52/726.4; 362/431, 153.1, 276, 362/802; 361/601; 439/474; 315/312, 324
See application file for complete search history.

(56) References Cited

U.S. PATENT DOCUMENTS 3,596,141 A * 7/1971 Jones et al. ..... 361/664
4,906,818 A * 3/1990 Lumpp et al. ..... 392/375
5,003,135 A * 3/1991 Piccoli ..... 200/52 R
5,231,392 A * 7/1993 Gust ..... 340/932.2
5,245,507 A * 9/1993 Ericksen ..... 361/641
5,335,160 A * 8/1994 Savoca ..... 362/431
6,303,857 B1 * 10/2001 Ginsburg ..... 174/45 R
6,377,001 B2 * 4/2002 Levy ..... 315/312
7,164,996 B2 * 1/2007 Lee ..... 702/57
7,492,064 B1 * 2/2009 Vaughn ..... 307/119
2004/0094318 A1 * 5/2004 Koessler ..... 174/50

* cited by examiner

*Primary Examiner*—Michael A Friedhofer
(74) *Attorney, Agent, or Firm*—Law Office of J. D. Pemberton

(57) ABSTRACT

A device and method that contains an electro-mechanical break away sensor that de-energizes power or stops the flow of electricity to a pole upon a vehicle colliding with the pole or otherwise activation of the sensor. The sensor is omni directional and operates regardless of direction of impact from the vehicle or activation and has the ability to disconnect power when the pole falls due to a shear impact such as when there is a collision or the pole falls due to tension created by wind or weight failure. The sensor may also be activated by an authorized user such as one that is performing maintenance on the pole.

20 Claims, 4 Drawing Sheets

BREAK AWAY BASE FOR ELECTRICAL DEVICE

BACKGROUND OF THE INVENTION

1. Technical Field

This invention relates to electrical devices, and more particularly, to an electrical device in a break away base for a pole that contains or supports a second electrical device.

2. Description of Related Art

Most if not all of the states and municipalities in the continental United States have poles such as light poles, sign post, or traffic signal poles that contain or support an electrical device. Often, the poles are equipped with a base that is intended to break-away when impacted by an errant vehicle. The breakaway base reduces the severity of the accident by reducing the errant vehicle's maximum change in momentum and allows the errant vehicle to continue on its path instead of being brought to a sudden stop.

Within the break-way base there is typically a pull apart wire disconnect wherein during a collision the wires are disconnected by a wire pull apart style disconnect device that depends on the wire terminal strength to pull the wires apart. The pulling apart of the wires turns off power or otherwise stops the flow of electricity to the wires going up to the electrical device attached to the pole. Unfortunately, often the wires have an extended length prior to and after they are pulled apart and once the wires are pulled apart, power is not removed from the wiring at the pole's foundation or foundation side of the disconnect. If the hot end of the wiring extending from the foundation side were to get wet, nicked, or snagged by the errant vehicle, there could be an immediate danger of electric shock or fire.

What is needed is a system or method that does not depend on the wire terminal strength to pull the wires apart, does not have an extended length prior to and after pulling the wires apart, and reduces or eliminates the likelihood that the wiring at the pole's foundation could become energized and cause an immediate danger of electrical shock or fire. It would also be beneficial if the system or method could be relatively easily activated or triggered by an authorized user to stop the flow of electricity to the pole during maintenance yet enable power to be restored to the pole in a relatively quick, cost efficient manner once the maintenance was completed.

SUMMARY OF INVENTION

The present invention solves the above-described problem by providing a device and method that contains an electromechanical break away sensor that de-energizes power or stops the flow of electricity to a pole upon a vehicle colliding with the pole or otherwise activation of the sensor. The pole may be a light pole, sign post, traffic signal pole, or any other breakaway element used in roadway design wherein it would be desirable to stop the flow of electricity at the foundation or conduit level of the pole. The sensor is omni directional and operates regardless of direction of impact from the vehicle or activation and has the ability to disconnect power when the pole falls due to a shear impact such as when there is a collision or the pole falls due to tension created by wind or weight failure. In addition, the sensor may also be activated or triggered by an authorized user such as one that is performing maintenance on the pole.

In one embodiment, the sensor is at least partially contained in a flat junction box or j-box. The term "pancake" will be used to describe a flat junction box, j-box, and other similar devices that could contain the sensor. In one embodiment, the pancake has a round profile with a flat bottom and a convex top such that when a vehicle drives over the pancake, the vehicle does not dislodge or excessively move the pancake. The pancake may have almost any profile that can contain the necessary elements to disconnect power or electricity to the pole but not dislodge or excessively move when an errant vehicle drives over it.

In one embodiment, the sensor is a lever operationally attached to a micro switch such that the micro switch is designed to be deactivated or triggered by the physical motion of the lever. The lever extends vertically up from the micro switch through the top cover of the pancake and may be magnetically retained to the pancake. In another embodiment, the housing for the micro switch contains a recess that accepts the bottom portion of the lever. The recess reduces a casual or unintentional displacement of the lever and activation or deactivation of the switch.

In use, when the lever is placed on the micro switch, current is allowed to flow from the wiring in the conduit to the pole. The lever extends high enough such that a falling or sheared pole will knock the lever off of the micro switch and thereby stop the flow of electricity to the wires in the pole at the pole's foundation.

Activation of the lever is based on the length of the lever extending perpendicularly from the micro switch and the width of the bottom of the lever where it sits or rests on the micro switch. The height of the lever is tall enough and the width of the bottom is small enough such that a small movement at the top portion of the lever induces a large displacement at the bottom of the lever. Consequently, the system does not require a large pole displacement to knock the lever off the micro switch thereby triggering the micro switch and stopping the flow of electricity. This is an improvement over the prior art because the present invention only needs a relatively small movement to disconnect the power whereas in the prior art, the wires needed to be stretched to full length and then pulled apart before the power was disconnected.

In addition, the system not only acts as a breakaway switch but can also provide a legitimate disconnect means for maintenance operations wherein the power or electricity flowing to the pole is turned off simply by removing the lever. Then, when power needs to be restored, the lever is simply placed back on the micro switch. The system reduces the time between the power off state of the pole when compared with conventional pull-the-plug-apart technology and the present invention can be used to relatively easily disconnect and reset power to the pole multiple times.

In other embodiments, the micro switch is deactivated or triggered by other means, including but not limited to a beam such as a laser wherein once the beam is broken, the micro switch is activated, magnetic means, a chain attached to a switch, or any other means able to detect a collision with the light pole and in response deactivated or triggered the micro switch or other switch or electromechanical or electrical means that may be used to stop the flow of electricity to the light pole.

DETAILED DESCRIPTION OF THE INVENTION

Figure 1:
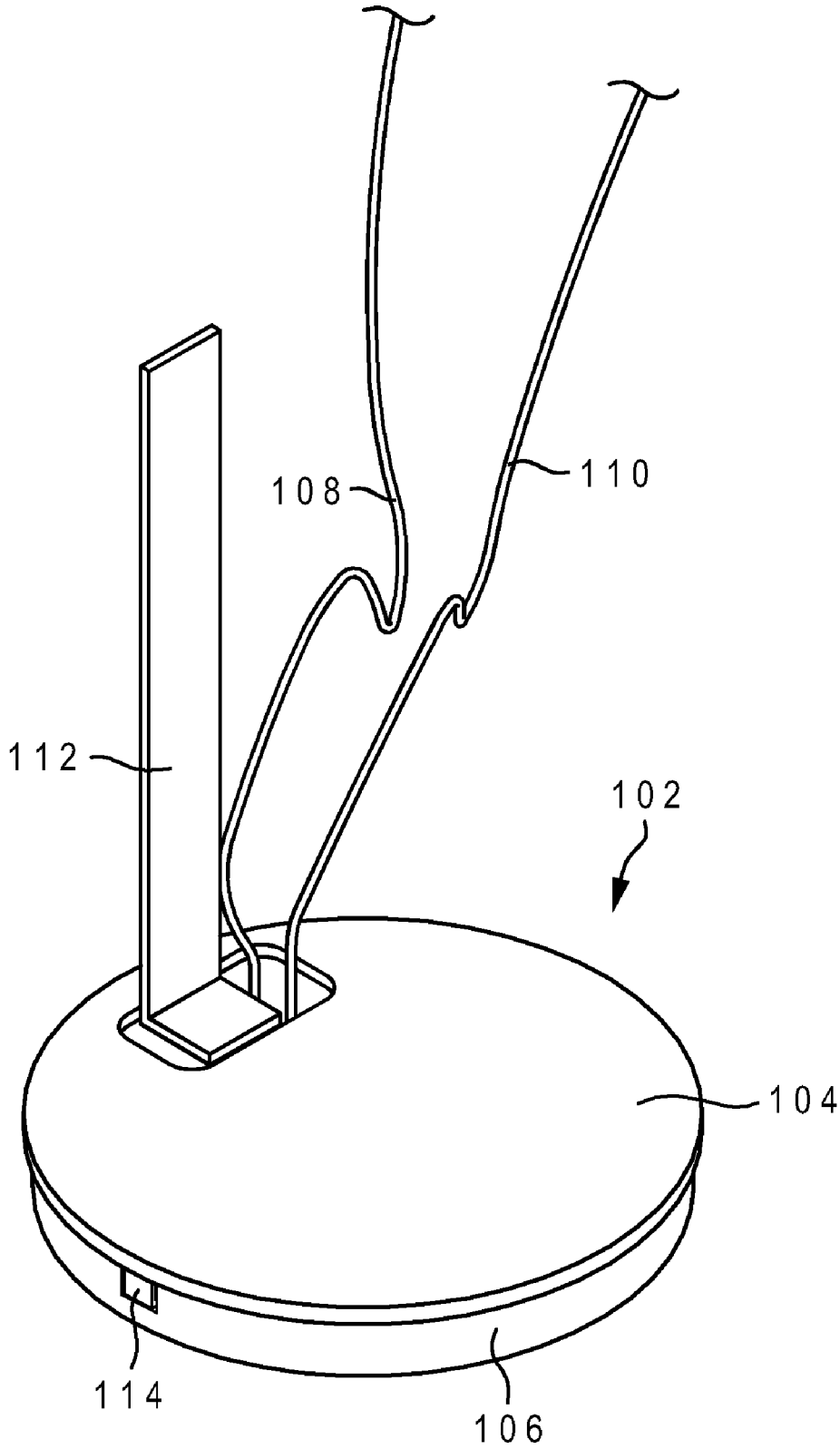
FIG. 1 is an isometric view of a pancake wire way base in accordance with an embodiment of the present invention.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings are indicated with like reference numerals and similar features as shown in alternate embodiments in the drawings are indicated with similar reference numerals.

Referring to FIG. 1, shown is pancake wire way 102. Pancake wire way 102 contains pancake cover 104, pancake base 106, sensor lever 112. Pancake cover 104 has a profile that allows pancake cover 104 to securely fit over pancake base 106 and in one embodiment, pancake cover 104 has a convex shape to help prevent pancake wire way 102 from being dislodged or significantly moved when a vehicle passes over it. In one embodiment, pancake cover 104 contains lock 114 such that once pancake cover 104 is in place, it can be locked or secured so that pancake cover 104 cannot be removed by an unauthorized user. Lock 114 may be a key lock, combination lock, or some other type of lock that can secure pancake cover 104 to pancake base 106. Pancake base 106 is made of a rigid or semi rigid material that is able to withstand moisture and in one embodiment, pancake cover 104 creates a watertight or relatively watertight seal with pancake base 106. Pancake base 106 is shown in more detail in FIG. 2.

Figure 2:
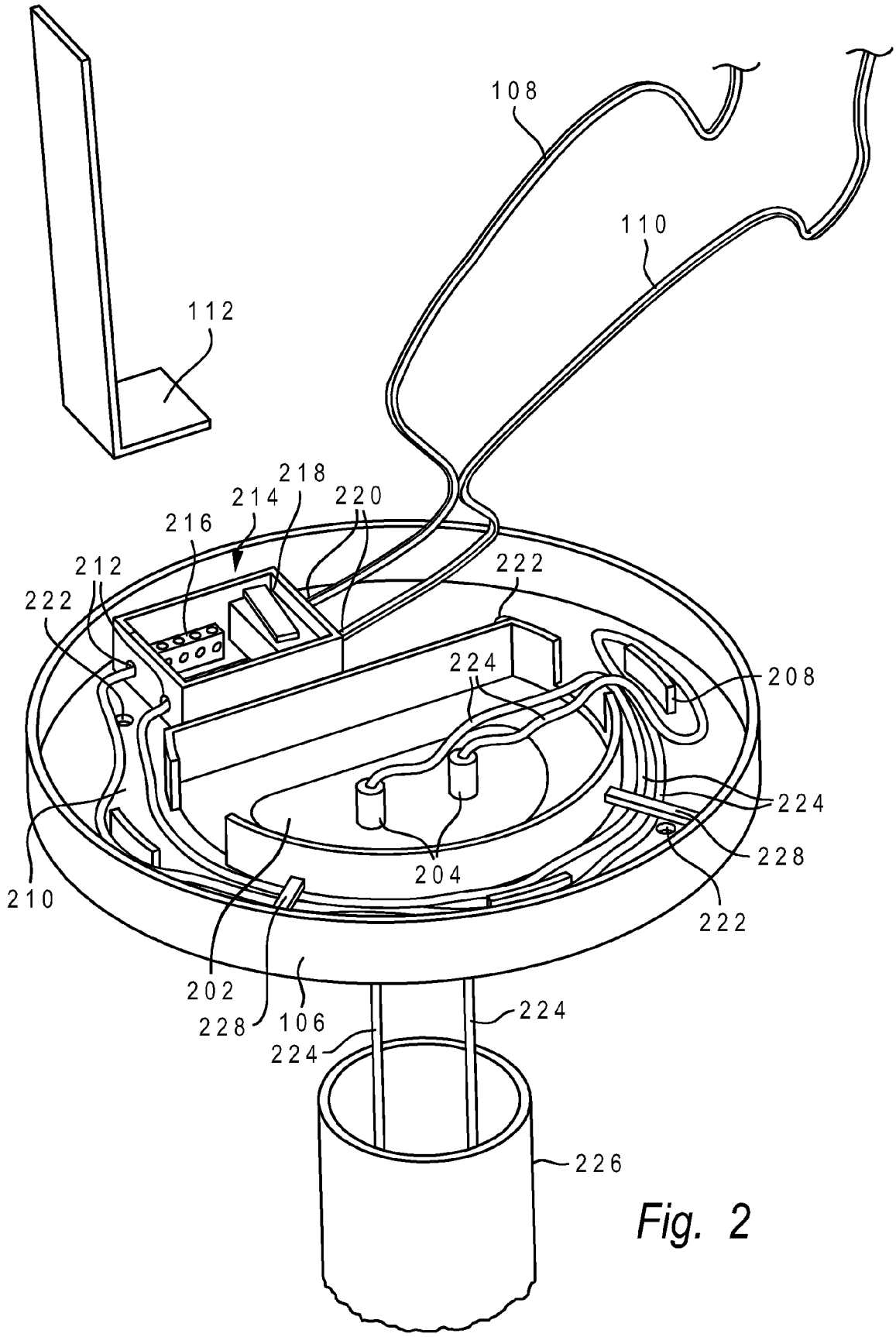
FIG. 2 is an isometric view of a pancake wire way base without a lid in accordance with an embodiment of the present invention.

As shown in FIG. 2, pancake base 106 contains conduit wire hole 202, wire way retainer 204, perpendicular protrusion 208, wire way 210, inlet holes 212, micro switch box 214, switch box terminals 216, micro switch 218, outlet holes 220, and mounting means 222. Mounting means 222 helps secure pancake base 106 to the ground or base of the pole and prevents movement of pancake wire way 102 during use. Mounting means 222 may be screws, bolts, or some other means that allows pancake base 106 to be secured to the ground or base of the pole.

Conduit wire hole 202 acts as a guide when installing pancake wire way 102 and is large enough to allow existing wire 224 from existing conduit 226 to be brought into pancake base 106. In one embodiment, pancake base 106 fits over existing conduit 226. In another embodiment, pancake wire way 102 is not located over existing conduit 226 and wires 224 extend from existing conduit 226 to pancake wire way 102. Wire way retainer 204 houses at least a portion of wire 224 and are wire way retainers that temporarily secure wire 224 while cover 104 is being installed.

Once conduit wire 224 is brought through conduit wire hole 202, it may be wound around at least one perpendicular protrusion 208 to take up any extra slack in conduit wire 224. Typically, when a break away pole is installed, extra wiring is pulled from conduit 226 to allow for slack in the line. The extra slack ensures that enough wire exists for any maintenance that might be needed at a later date. However, in the prior art, after the wire is separated by the break away device, the slack, or extra length of wire 224 can create a problem by having the live end of wire 224 extend a relatively large distance from conduit 226. In the present invention, by wrapping the slack around perpendicular protrusion 208 and containing the slack inside pancake wire way 102, there is enough wire 224 if needed for maintenance, yet the live end of wire 224 does not extend outside of pancake wire way 102.

After wire 224 is wound around at least one perpendicular protrusion 208, it is run along wire way 210 and into inlet holes 212 on micro switch box 214. Wire way 210 extends from conduit wire hole 202 to the outside of pancake base 106 and is used to contain any remaining slack after wire 224 is wound around at least one perpendicular protrusion 208. In one embodiment, pancake base 106 does not contain at least one perpendicular protrusion 208 and if there is excess wire 224, it may be looped several times around the inside of pancake base 106 along wire way 210.

In another embodiment, wire stays 228 are inserted over wire 224 after wire 224 is run along wire way 210. Wire stays 228 help keep wire 224 contained in wire way 210, especially when pancake cover 104 is being inserted over pancake base 106. Through the use of conduit wire hole 202, perpendicular protrusion 208, and wire way 210 the handling and storage of wire 224 is organized and contained within wire way 210. After wire 224 is run along wire way 210, it is inserted into inlet holes 212 on micro switch box 214.

Switch box 214 contains switch box terminals 216 and micro switch 218. Once wire 224 is through inlet holes 212, wire 224 is connected to switch box terminals 216. Switch box terminals 216 provide a secure connection for wire 224 from conduit 226. Switch box terminals 216 are operationally connected to micro switch 218. In one embodiment, switch box 214 is waterproof, relatively water proof, rain resistant, or moisture resistant.

In one embodiment, switch box terminals 216 and micro switch 218 are waterproof, relatively water proof, rain resistant, or moisture resistant. In another embodiment, micro switch 218 is rubber encased separate from the field wiring waterproofing such that the field wiring does not affect micro switch's 218 waterproof integrity. In another embodiment, micro switch 218 is encased in a flexible rubber bag wherein the flexible rubber bag is similar to a common balloon. In this embodiment, micro switch 218 can be operated though the flexible rubber bag and sensor lever 112 may be held in contact with micro switch 218 via magnetic means or other means that may hold sensor lever 112 in contact with micro switch 218.

Micro switch 218 is an electric switch that is designed to be actuated by a sensor such as sensor lever 112 and contains connections for wires 108 and 110. When deactivated or triggered, micro switch 218 stops the flow of electricity from conduit wire 224 to wires 108 and 110. Sensor lever 112 extends vertically up from micro switch 218 and through pancake cover 104. In other embodiments, micro switch 218 is actuated by other means, including but not limited to a beam such as a laser, magnetic means, a chain attached to a switch, or any other means able to detect a collision with a pole and in response trigger micro switch 218 and stop the flow of electricity to wires 108 and 110.

Figure 3:
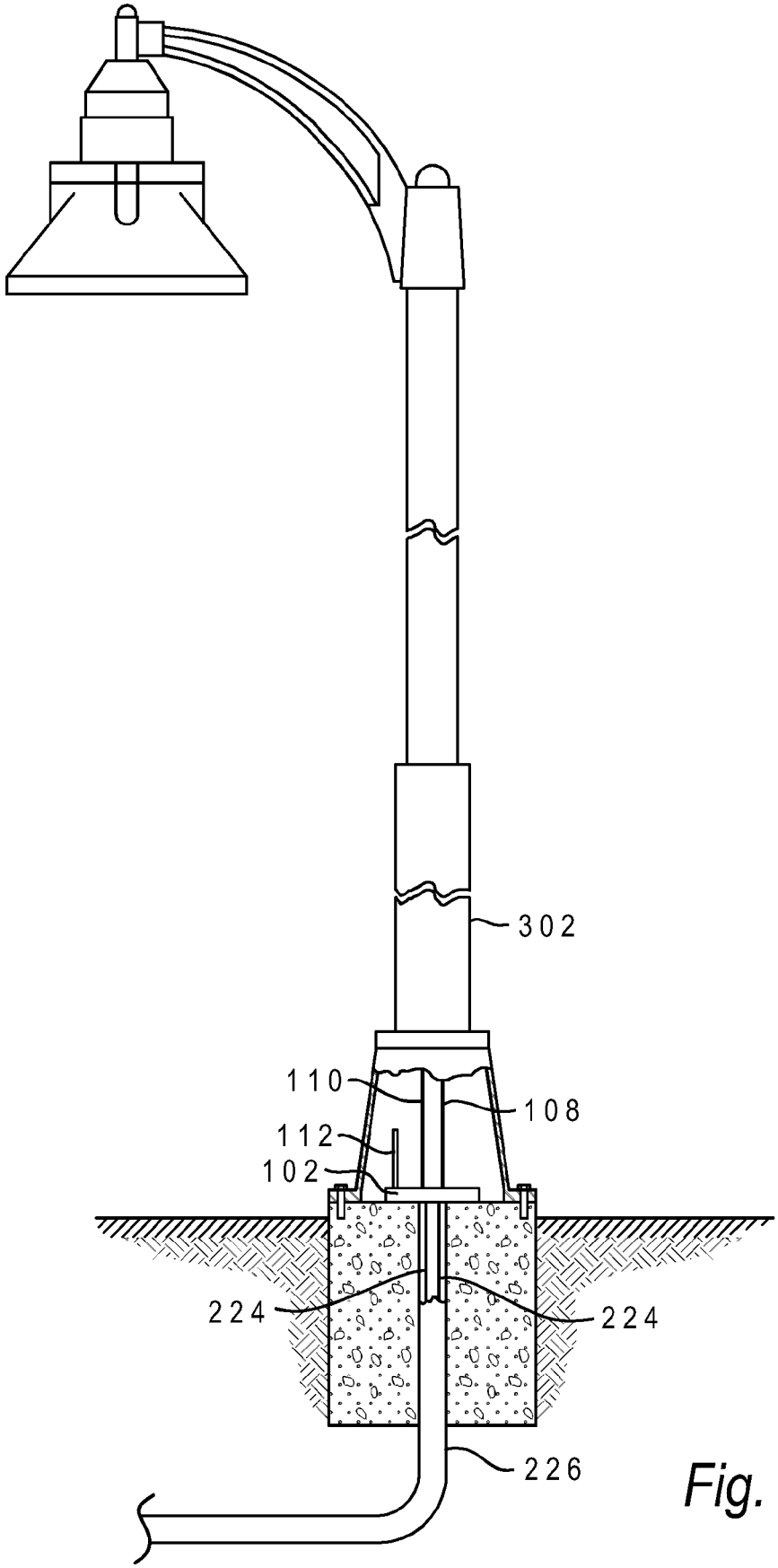
FIG. 3 is an plan view of a pancake wire way installed on a light pole in accordance with an embodiment of the present invention.

When sensor lever 112 is placed on micro switch 218, current is allowed to flow from wire 224 in conduit 226, through switch box terminals 216 and micro switch 218 to wires 108 and 110 and to the electrical device on or supported by pole 302 shown in FIG. 3. The electrical device may be a street light, sign posts, traffic signals, or any other electrical device supported by a breakaway element wherein it would be desirable to stop the flow of electricity to the electrical device at the conduit level.

Activation of sensor lever 112 is based on the length of sensor lever 112 extending perpendicularly from micro switch 218 and the width of the bottom of sensor lever 112 that sits or rests on micro switch 218. Sensor lever 112 is high enough such that a falling or sheared pole 302 knocks sensor lever 112 off of micro switch 218 and deactivates or triggers micro switch 218. Once this happens, the electrical connection to wires 108 and 110 is interrupted and the current flow through wires 108 and 110 is stopped. Because pole 302 is more likely to be sheared off rather than tip over, in one embodiment, the height of sensor lever 112 is at least about 8.5 inches or high enough to ensure the bumper from an errant vehicle contacts and knocks sensor lever 112 off of micro switch 218.

In addition to stopping the flow of electricity to pole 302 in response to a collision, pancake wire way 102 can also relatively easily stop the flow of electricity during maintenance of pole 302 simply by removing sensor lever 112 and deactivating or triggering micro switch 218. Then when the maintenance is completed and power needs to be restored to pole 302, sensor lever 112 is simply placed back on micro switch 218 and electricity is allowed to flow through wires 108 and 110. In one embodiment, after the flow of electricity has been stopped, micro switch 218 must be reactivated by an administrator of the system. For example, after a collision with pole 302 from an errant vehicle and deactivation of micro switch 218, sensor lever 112 can only be placed back onto micro switch 218 by an administrator.

To ensure that only an administrator can reset or reactivate the system, a reset mechanism such as a reset button is present wherein only an administrator knows the location or method to activate the reset mechanism or the reset mechanism is housed in pancake wire way 102 and can only be accessed after lock 114 has been opened. By having a reset mechanism that can only be accessed or activated by an administrator, the risk of accidental reactivation of the power to pole 302 is greatly reduced.

Figure 4:
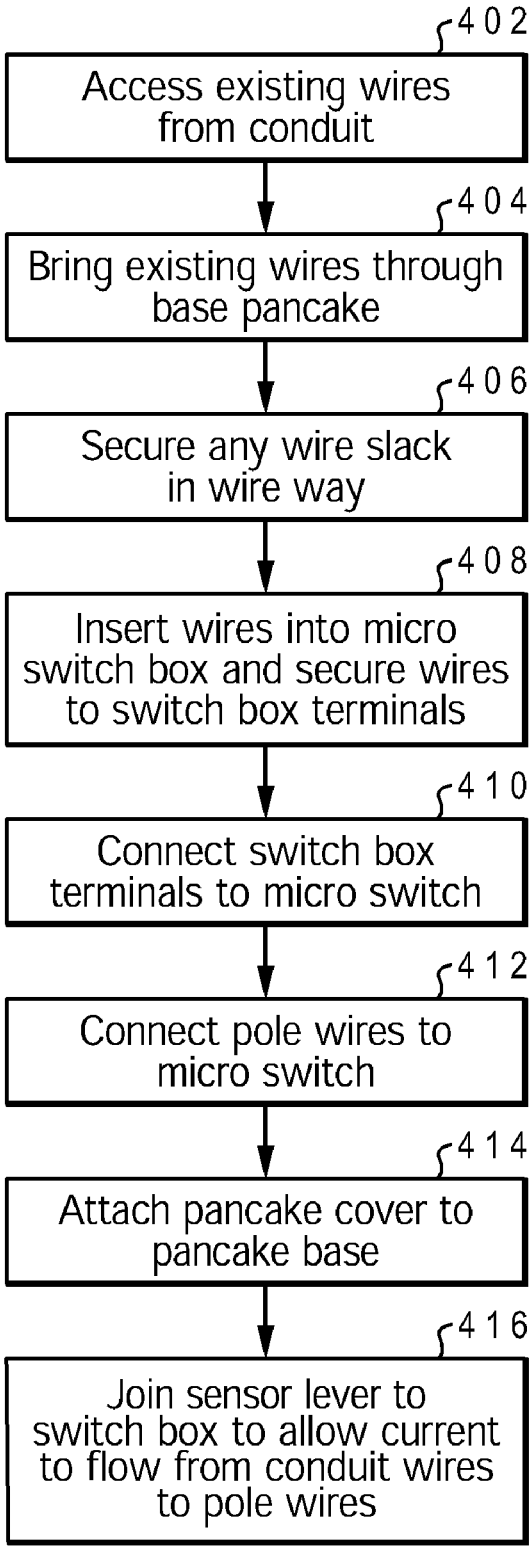
FIG. 4 is a block diagram showing the pancake wire way base installed in a light pole in accordance with an embodiment of the present invention.

To use pancake wire way 102, first a conduit is located and the wires inside the conduit are accessed, Step 402, FIG. 4. Then the conduit wires are brought through pancake base 106, Step 404. Next, any slack in the wire from the conduit is secured in wire way 210, Step 406. If micro switch box 214 is present, the wire from the conduit is operationally connected to micro switch box 214, typically via switch box terminals 216, Step 408. Next, switch box terminals 216 are operationally connected to micro switch 218, Step 410. If micro switch box 214 is not present, or micro switch box 214 does not contain switch box terminals 216, the wire from the conduit is operationally connected to micro switch 218. After the wire is connected to micro switch 218, micro switch 218 is operationally connected to the wire in the pole, Step 412. Then, pancake cover 104 is attached to pancake base 106, Step 414. Finally, sensor lever 112 is joined to micro switch 218 such that micro switch 218 is activated and electricity can flow from the wire in the conduit, through micro switch 218, and to the wiring in the pole, Step 416.

It should be understood that the foregoing relates to exemplary embodiments of the invention and that modifications may be made without departing from the spirit and scope of the invention as set forth in the following claims.

What is claimed is:

1. A pancake wire way for stopping the flow of electricity to a pole, the pancake wire way comprising:

a cover; and a wire way base secured to a base of the pole, wherein the wire way base securely connects to the cover and contains:

a conduit wire hole wherein wire from a conduit can enter the wire way base;

a micro switch that operationally connects to the wire from the conduit wires and operationally connects to wire that supplies electricity to a pole and can stop the flow of electricity from the wire from the conduit to the wire that supplies electricity to the pole; and a mechanism for triggering the micro switch, wherein the micro switch is triggered when the mechanism engages the pole, and wherein the cover and the wire way base are contained within the base of the pole.

2. The pancake wire way of claim 1, wherein the mechanism for triggering the micro switch is a lever that extends vertically up from the micro switch and through the pancake cover wherein when the sensor lever is placed on the micro switch, current is allowed to flow from the wire in the conduit to the wire that supplies electricity to the pole.

3. The pancake wire way of claim 1, wherein the cover has a convex shape.

4. The pancake wire way of claim 1, wherein the cover or the wire way base contains a lock such that when the wire way base is securely connected to the cover the lock can be activated to prevent unauthorized access to the micro switch.

5. The pancake wire way of claim 1, wherein the pancake cover and the wire way base create a waterproof, relatively water proof, rain resistant, or moisture resistant seal.

6. The pancake wire way of claim 1, wherein the wire way base contains a wire way and a perpendicular protrusion for storing any slack in the wire from the conduit.

7. The pancake wire way of claim 1, wherein the micro switch is housed in a switch box and the switch box further contains switch box terminals wherein the switch box terminals aid in connecting the wire from the conduit to the micro switch.

8. The pancake wire way of claim 1, wherein the sensor lever is held in contact with the micro switch via magnetic means.

9. The pancake wire way of claim 1, wherein the height of sensor lever is at least about 8.5 inches.

10. The pancake wire way of claim 1, wherein the micro switch includes a reset mechanism that must be activated before electricity can flow from the wire in the conduit to the wires in the pole.

11. The pancake wire way of claim 1, wherein the pancake wire way is not located over the conduit.

12. A method for stopping the flow of electricity to a pole, the method comprising the steps of:

accessing wire from a conduit;

inserting the wires into to a pancake wire way wherein the pancake wire way contains:

a cover; and a wire way base that fits over the conduit, wherein the wire way base securely connects to the cover and contains a conduit wire hole wherein the wire from the conduit can enter the wire way base;

a micro switch that operationally connects to the wire from the conduit wire and the wire that supplies electricity to a pole wherein the micro switch can stop the flow of electricity from the wire from the conduit to the wire that supplies electricity to the pole; and a mechanism for activating the micro switch;

connecting the wire from the conduit to the micro switch in the pancake wire way;

connecting the micro switch in the pancake wire way to the wire that supplies electricity to the pole;

activating the micro switch such that electricity can flow from the wire in the conduit to the wire that supplies electricity to the pole, wherein the micro switch is activated when the mechanism engages the pole.

13. The method of claim 12, wherein the cover or the wire way base contains a lock such that when the wire way base is securely connected to the cover, the lock can be activated.

14. The method of claim 12, wherein the pancake cover and the wire way base create a waterproof, relatively water proof, rain resistant, or moisture resistant seal.

15. The method of claim 12, wherein the wire way base contains a wire way and perpendicular protrusion for storing any slack in the wire from the conduit.

16. The method of claim 12, wherein the means for activating the micro switch is a sensor lever that is held in contact with the micro switch via magnetic mean.

17. The method of claim 12, wherein the micro switch includes a reset mechanism that much be activated before electricity can flow from the wire in the conduit to the wires in the pole.

18. A pancake wire way for stopping the flow of electricity to a pole, the pancake wire way comprising:

a cover; and a wire way base that securely connects to the cover to create a rain proof enclosure and contains:

a conduit wire hole wherein wire from a conduit can enter the wire way base;

a micro switch that operationally connects to the wire from the conduit wires and operationally connects to wire that supplies electricity to a pole and can stop the flow of electricity from the wire from the conduit to the wire that supplies electricity to the pole;

a wire way and a perpendicular protrusion for storing any slack in the wire from the conduit; and a mechanism for activating the micro switch, wherein the micro switch is activated when the mechanism engages the pole and wherein the cover and the wire way base are contained within a base of the pole.

19. The pancake wire way of claim 18, wherein the cover or the wire way base contains a lock such that when the wire way base is securely connected to the cover the lock can be activated to prevent unauthorized access to the micro switch.

20. The pancake wire way of claim 18, wherein the micro switch includes a reset mechanism that much be activated before electricity can flow from the wire in the conduit to the wires in the pole.

* * * * *